US007515113B2

(12) United States Patent
Petros

(10) Patent No.: US 7,515,113 B2
(45) Date of Patent: Apr. 7, 2009

(54) ANTENNA WITH PARASITIC RINGS

(75) Inventor: Argy Petros, Parkland, FL (US)

(73) Assignee: Think Wireless, Inc., Parkland, FL (US)

( * ) Notice: Subject to any disclaimer, the term of this patent is extended or adjusted under 35 U.S.C. 154(b) by 0 days.

(21) Appl. No.: 10/709,511

(22) Filed: May 11, 2004

(65) Prior Publication Data

US 2004/0257297 A1 Dec. 23, 2004

Related U.S. Application Data

(60) Provisional application No. 60/320,280, filed on Jun. 17, 2003.

(51) Int. Cl.
*H01Q 1/36* (2006.01)

(52) U.S. Cl. ..... 343/833; 343/895

(58) Field of Classification Search ..... 343/895, 343/833

See application file for complete search history.

(56) References Cited

U.S. PATENT DOCUMENTS

| | | | | |
|---|---|---|---|---|
| 1,606,476 | A * | 11/1926 | Mauborgne et al. | 342/448 |
| 6,184,844 | B1 * | 2/2001 | Filipovic et al. | 343/895 |
| 6,788,272 | B2 * | 9/2004 | McCarthy et al. | 343/895 |
| 7,133,810 | B2 * | 11/2006 | Butler et al. | 703/2 |

* cited by examiner

*Primary Examiner*—Michael C Wimer
(74) *Attorney, Agent, or Firm*—Pablo Meles; Akerman Senterfitt

(57) ABSTRACT

A quadrifilar helix antenna comprises a flexible substrate, four conductive elements with a feed network etched on a first portion of the flexible substrate, parasitic metallic lines etched on a second portion of the flexible substrate and a ground plane for the feed network. The resulting antenna structure is capable of efficiently receiving both satellite and terrestrial SDARS (Satellite digital audio radio service) signals.

17 Claims, 8 Drawing Sheets

ANTENNA WITH PARASITIC RINGS

CROSS REFERENCE TO RELATED APPLICATIONS

This is a non-provisional or utility patent application corresponding to provisional application titled "Quadrifilar Antenna", Application No. 60/320,280, filed on Jun. 17, 2003 (EFS ID: 42034).

BACKGROUND OF INVENTION

Satellite digital audio radio service (SDARS) is a satellite broadcast service recently approved by the U.S. Federal Communications Commission (FCC) which provides satellite transmission of digital audio programs to compatible radio receivers. The radio receivers can be stationary or mobile and are generally configured to receive signals from satellites as well as terrestrial repeaters.

Currently, existing SDARS automotive antenna modules are dual-arm modules: one designed to receive terrestrial (TER) signals and the other designed to receive satellite (SAT) signals. These dual-arm modules comprise two passive antenna elements, two low noise amplifiers (LNAs), and two radio frequency (RF) cables.

Recently, single-arm automotive roof-mount antennas have been developed. These are patch antennas which are ground dependent, i.e., they must be placed on a metallic surface of dimensions of at least ten times the size of the antenna footprint area for acceptable performance in SDARS applications. These patch antennas, when placed at a proper location on a vehicle roof, have acceptable gain at the horizon (for receiving TER signals) and acceptable gain between 20 and 90 degree elevation angles (for receiving SAT signals). As a result, new single-branch receivers are now being designed resulting in a lower receiver/antenna cost.

There is a need then, for single-arm mast-type (ground-independent) antennas. These types of antennas can be used in the place of dual-arm glass-mount and mast SDARS antennas.

A typical mast-type ground-independent antenna used in SDARS applications, is a printed quadrifilar antenna which consists of four helices spaced equally and circumferentially on a cylinder. FIG. 1 [from reference: "Combination linearly polarized and quadrifilar antenna," A. Petros, U.S. Pat. No. 6,483,471] shows such a quadrifilar antenna consisting of four helical elements and feed network printed on a flexible substrate. As discussed in Antenna Engineering Handbook by Richard C. Johnson and Henry Jasik, pp. 13-19 through 13-21 (1984), a quadrifilar helix (or volute) antenna is a circularly polarized antenna having four orthogonal fractional turn helixes excited in phase quadrature. Each helix is balun-fed at the top or bottom with four helical arms of wires or metallic strips of resonant lengths (l=.lambda./4, m=1, 2, 3, . . . ) wound on a small diameter with a large pitch angle.

One embodiment of the novel antenna structure is shown in FIG. 2. It is a combination of quadrifilar antenna and substantially parallel and substantially concentric metallic rings positioned along the longitudinal axis of the quadrifilar antenna. This antenna is capable of efficiently receiving both satellite and terrestrial signals. FIGS. 3 and 4 show additional embodiments of the present invention according to FIG. 2. FIGS. 5 and 6 show alternative embodiments of the novel antenna in accordance with the teachings of the present invention. The quadrifilar antenna elements and rings are arranged on cylindrical structures. These structures are in turn arranged to provide a novel antenna structure of the same radiation properties as the novel antenna structure of FIG. 2. As shown in FIGS. 7 and 8, the radiation pattern of the novel antenna shows improved performance on both SAT and TER cases over the standard quadrifilar antenna. This novel antenna then is an ideal structure for use in SDARS applications.

An additional benefit of the technique presented here is that it yields lower profile antennas. The height of antennas produced using this technique, is reduced by approximately 15%.

SUMMARY OF INVENTION

In a first aspect of the present invention, the novel quadrifilar helix antenna comprises a flexible substrate where, antenna elements are etched on a first portion of the flexible substrate, and metallic parasitic rings are etched on a second portion of the flexible substrate.

In a second aspect of the present invention, the novel quadrifilar helix antenna comprises a flexible substrate where, parts of antenna elements and parts of metallic parasitic rings are etched on the same portion of the flexible substrate.

In a third aspect of the present invention, the metallic rings are shaped into tubular form and inserted inside the tubular quadrifilar antenna.

In a fourth aspect of the present invention, the metallic rings are arranged in a tubular form and placed over and around the total or partial length of the tubular quadrifilar antenna.

In a fifth aspect of the present invention, the metallic rings and quadrifilar antenna elements are arranged on the same tubular structure.

In a sixth aspect of the present invention, a novel method is presented of reducing the height of a quadrifilar antenna by adding substantially circular metallic rings positioned concentrically and longitudinally along the whole or partial length of the quadrifilar antenna helical elements.

In a seventh aspect of the present invention, a novel method is presented of tuning a quadrifilar antenna by adding substantially circular metallic rings positioned concentrically and longitudinally along the whole or partial length of the quadrifilar antenna helical elements. For example, by removing one or more rings, the frequency of operation increases.

DETAILED DESCRIPTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
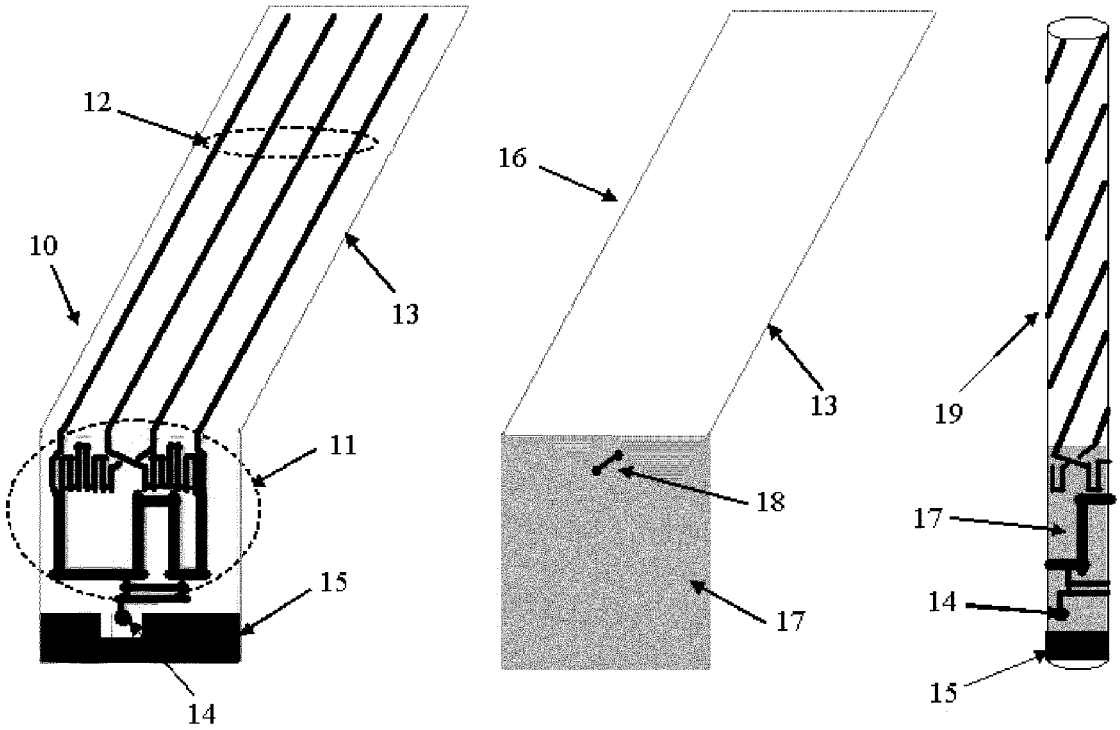
FIG. 1 PRIOR ART
FIG. 1 is a diagram that illustrates a conventional quadrifilar helix antenna and its feed network, etched on a thin flexible substrate in accordance with the teachings of the prior art.

Referring to FIG. 1, a front plane view of a front side 10 of a substrate 13 used for a conventional quadrifilar helix antenna 19 is shown. The antenna preferably comprises a quadrifilar antenna elements 12 and a feed network 11 etched on a first or top portion of the flexible substrate 13. The antenna feed point 14, along with ground 15, comprise a 50-Ohm point that connects to the receiver's LNA. The back side 16 of substrate 13 is comprised of a ground plane 17 and a short microstrip line with two vias at its ends 18 as part of feed network 11. Ground plane 17 is preferably directly underneath feed network 11.

Figure 2:
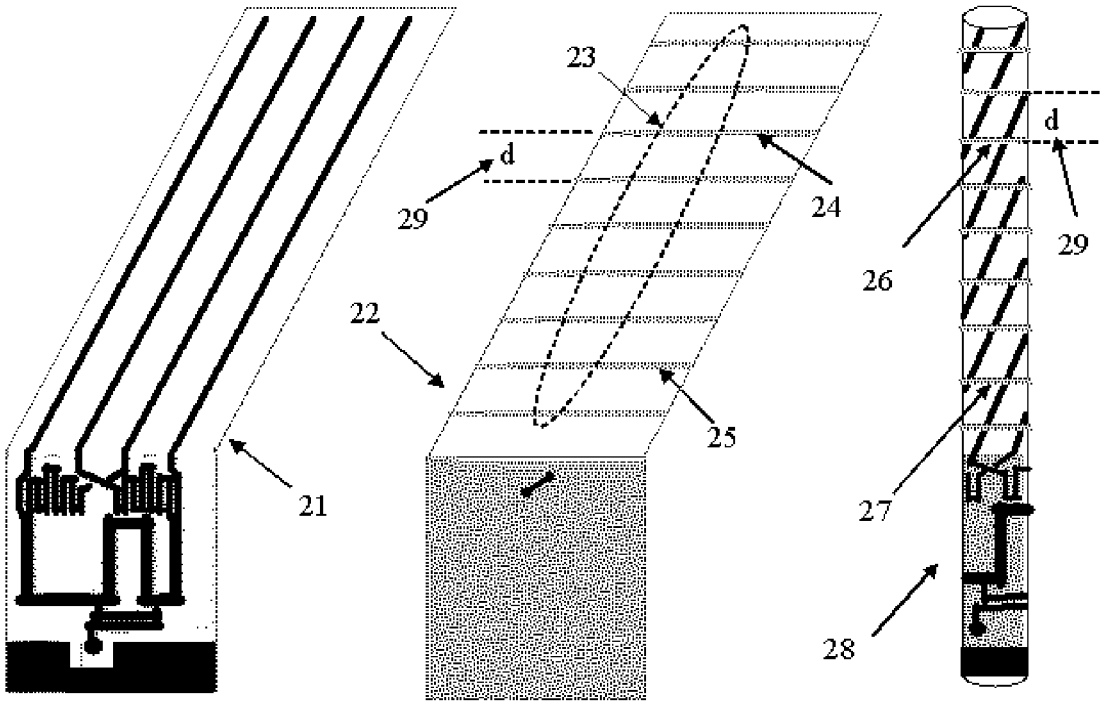
FIG. 2 is a diagram of an embodiment of the antenna arrangement of the present invention.

FIG. 2 shows the modified quadrifilar antenna 28 in accordance with the teachings of the present invention. The front side 21 of the antenna is of similar arrangement as that of the conventional quadrifilar antenna. Back side 22 is comprised of substantially horizontal and parallel etched metallic strips or lines 23 spaced at a distance d 29 with respect to each other. Lines 24 and 25 are such lines. When the quadrifilar antenna is shaped into a cylindrical form 28, the ends of these lines are connected forming parasitic metallic rings such as in 26 and 27 along the inside wall of quadrifilar antenna 28 and spaced at a distance d 29 with respect to each other.

Figure 3:
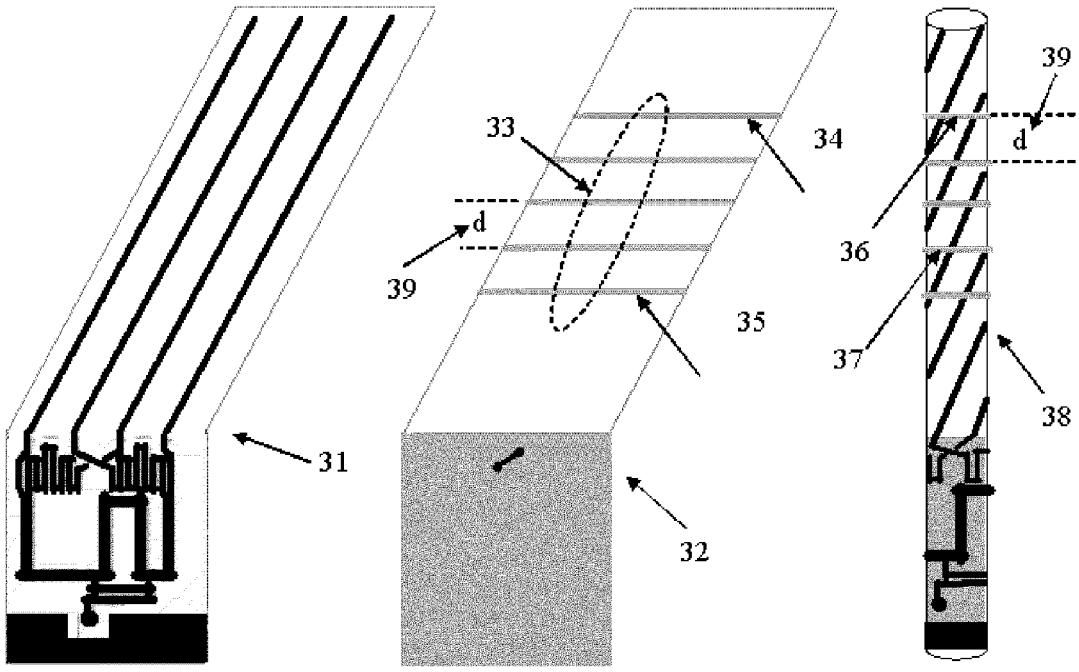
FIG. 3 is a diagram of an alternative embodiment of the of the antenna arrangement of FIG. 2.

FIG. 3 shows an alternative embodiment of the novel quadrifilar antenna in accordance with the teachings of the present invention. The front side 31 of the antenna is of similar arrangement as that of the conventional quadrifilar antenna. The back side 32 is comprised of substantially horizontal parallel lines 33 etched on a section of back side 32 and spaced a distance d 39 with respect to each other. Lines 34 and 35 are such lines. When the quadrifilar antenna is shaped into a cylindrical form 38, the ends of these lines are connected forming parasitic rings such as in 36 and 37 along a section of the inside wall of quadrifilar antenna 38 and spaced at a distance a 39 with respect to each other.

Figure 4:
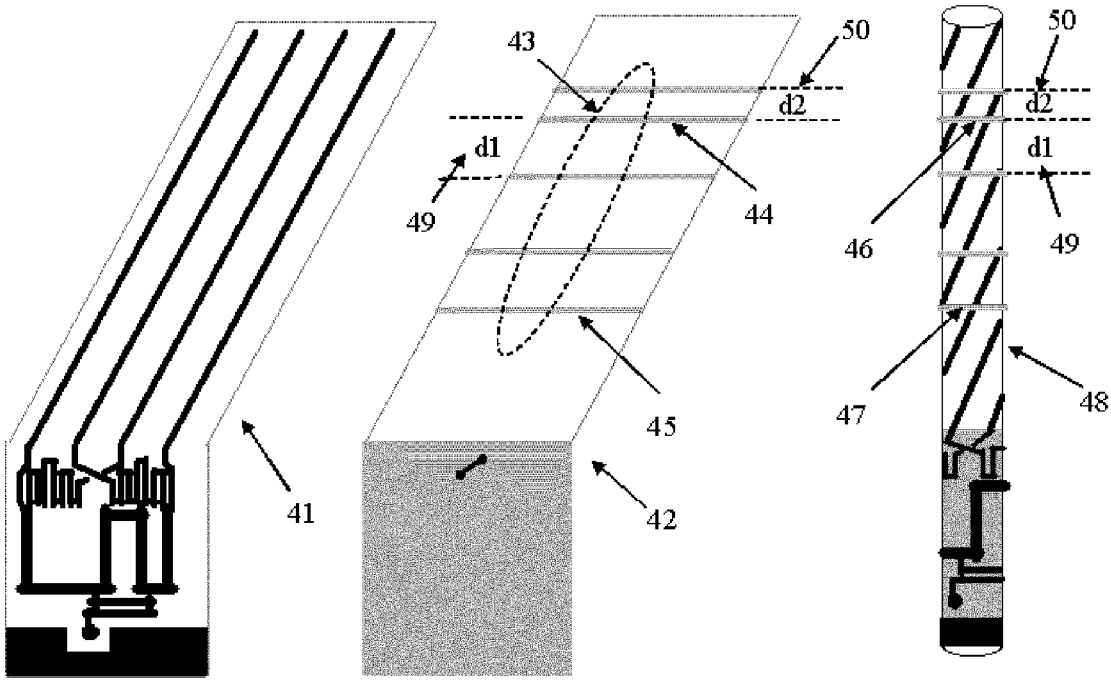
FIG. 4 is a diagram of an additional alternative embodiment of the antenna arrangement of FIG. 2.

FIG. 4 shows a different embodiment of the novel quadrifilar antenna in accordance with the teachings of the present invention. The front side 41 of the antenna is of similar arrangement as that of the conventional quadrifilar antenna. The back side 42 comprises of substantially horizontal parallel metallic lines 43 etched on a section of back side 42 and spaced at variable distances, i.e., d1 49 and d2 50, with respect to each other. Lines 44 and 45 are such lines. When the quadrifilar antenna is shaped into a cylindrical form 48, the ends of these lines are connected forming parasitic rings such as in 46 and 47 along a section of the inside wall of quadrifilar antenna 48 and spaced at variable distances with respect to each other.

Figure 5:
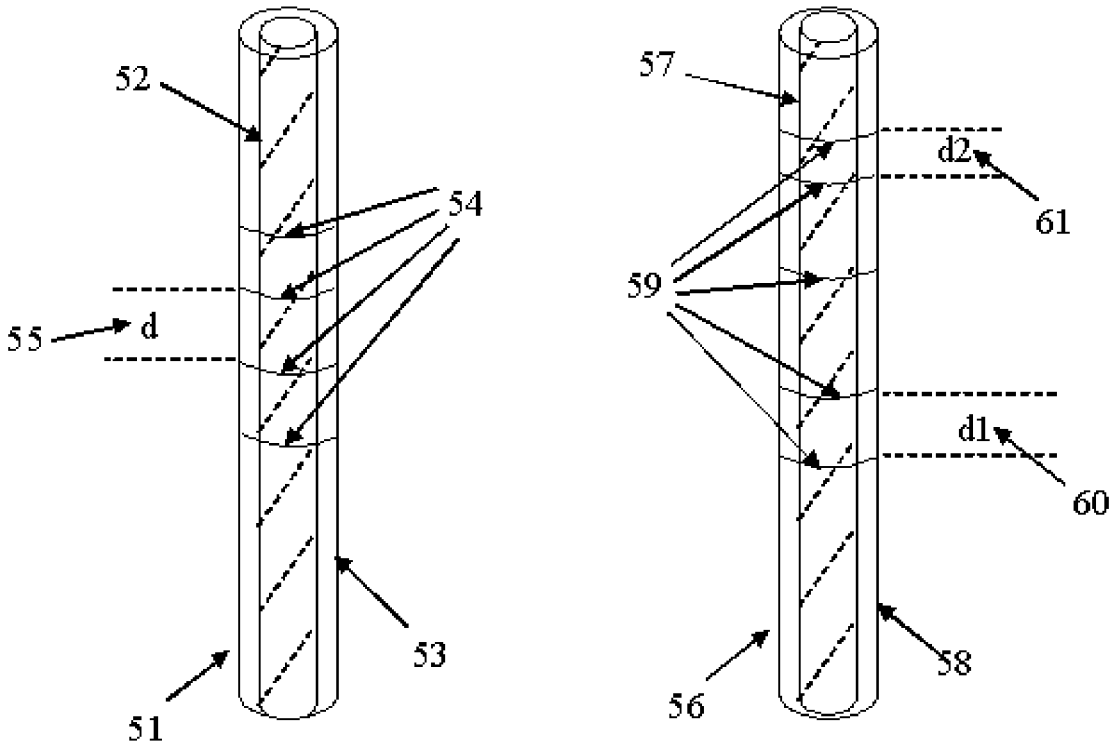
FIG. 5 is a diagram of an embodiment of the antenna arrangement of the present invention using two different substantially cylindrical structures.

FIG. 5 shows two other embodiments of the novel quadrifilar antenna in accordance with the teachings of the present invention. Antenna structure 51 is comprised of two substantially cylindrical structures: the quadrifilar antenna 52 and the tube 53 with metallic rings 54 attached to it. Tube 53 serves as a support structure for pings 54. The quadrifilar antenna tube 52 diameter is smaller than that of supporting tube 53. The substantially parallel metallic rings 54 are spaced a distance d 55 with respect to each other and wrap around and over a section of the quadrifilar antenna 52. Antenna structure 56 is comprised of two substantially cylindrical structures: the quadrifilar antenna 57 and the tube 58 with metallic rings 59 attached to it. Tube 58 serves as a support structure for pings 59. The substantially parallel metallic rings 59 are spaced at variable distances, i.e., d1 60 and d2 61, with respect to each other and wrap around and over a section of the quadrifilar antenna 57.

Figure 6:
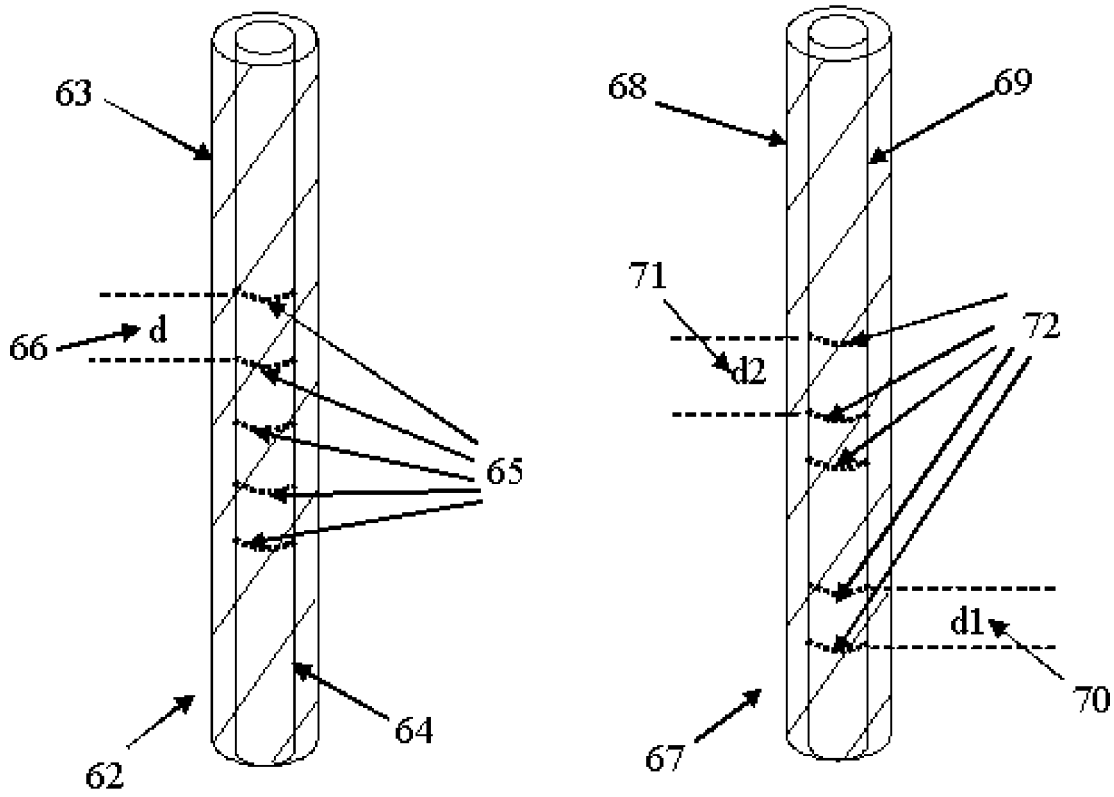
FIG. 6 is a diagram of an embodiment of the antenna arrangement of the present invention using two different substantially cylindrical structures.

FIG. 6 shows two more embodiments of the novel quadrifilar antenna in accordance with the teachings of the present invention. Antenna structure 62 is comprised of two substantially cylindrical structures: quadrifilar antenna 63 and tube 64 with metallic rings 65 attached to it. Tube 64 serves as a supporting structure for rings 65. The quadrifilar antenna tube 63 diameter is larger than that of supporting tube 64. The substantially parallel rings 65 are spaced a distance d 66 with respect to each other and are enclosed by quadrifilar antenna 63. Antenna structure 67 is comprised of two substantially cylindrical structures: quadrifilar antenna 68 and tube 69 with rings 72 attached to it. Tube 69 serves as a supporting structure for rings 72. The substantially parallel rings 72 are spaced at variable distances, i.e., d1 70 and d2 71, with respect to each other and are enclosed by quadrifilar antenna 68.

Figure 7:
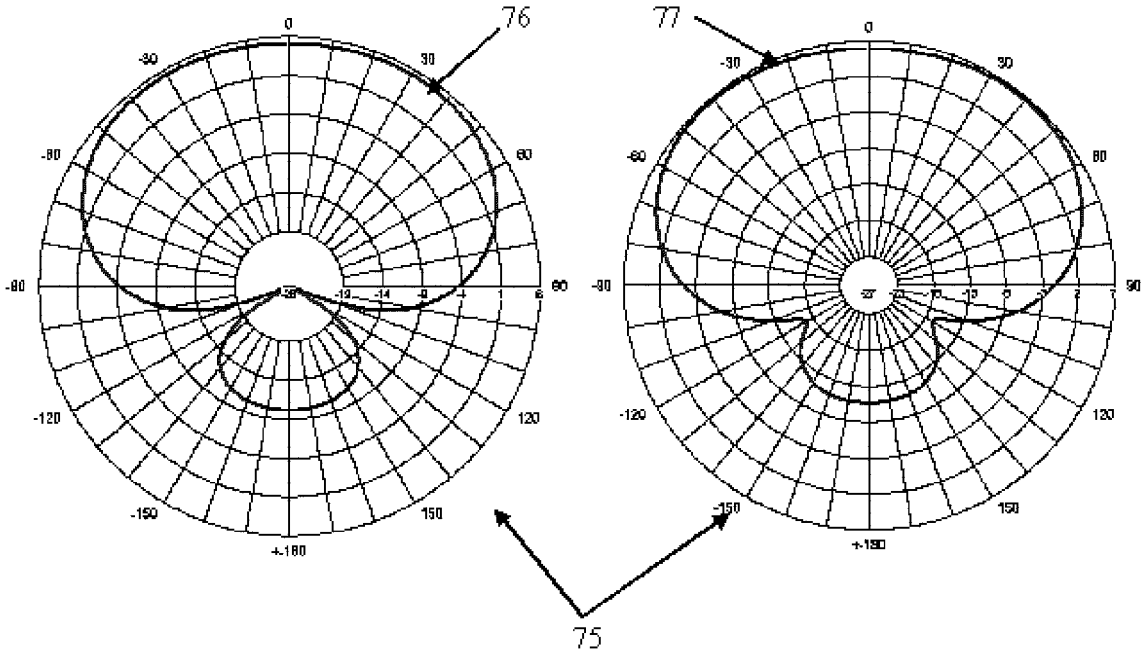
FIG. 7 shows a comparison of satellite radiation patterns generated by a typical conventional quadrifilar helix antenna and a quadrifilar helix antenna implemented in accordance with the teachings of the present invention.

The novel quadrifilar may be optimized to provide a desired radiation pattern. This is depicted in FIG. 7 which shows a comparison of satellite radiation patterns generated by a typical conventional quadrifilar helix antenna 76, and that of a quadrifilar helix antenna implemented in accordance with the teachings of the present invention 77. Two polar plots are shown in FIG. 7. Circle 75 represents elevation angles with zero degrees being zenith or directly above the antenna, and 60 degrees corresponds to the elevation angle of 30 degrees, and +/−180 degrees being directly below. As seen in FIG. 7, the satellite radiation pattern of the novel antenna exhibits slightly better gain.

Figure 8:
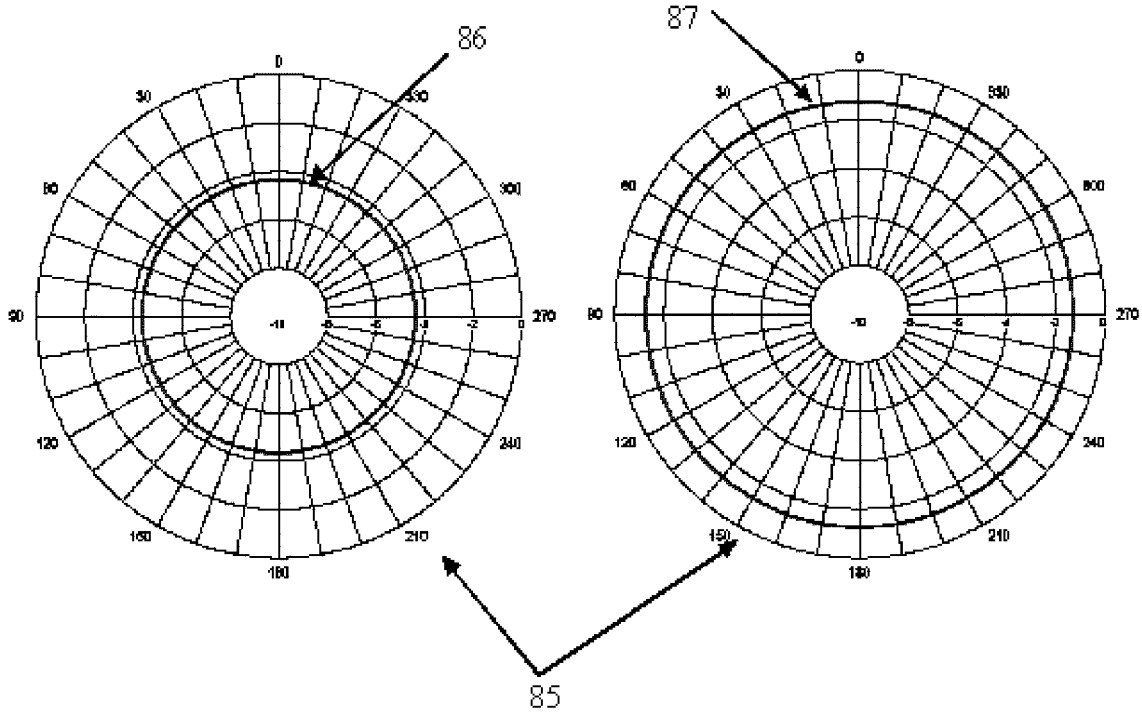
FIG. 8 shows a comparison of terrestrial radiation patterns generated by a typical conventional quadrifilar helix antenna and a quadrifilar helix antenna implemented in accordance with the teachings of the present invention.

The real advantage of the antenna implemented in accordance with the teachings of the present invention, is in the terrestrial performance, i.e., antenna gain along the horizon This is depicted in FIG. 8 which shows a comparison of terrestrial radiation patterns generated by a typical conventional quadrifilar helix antenna 86, and that of a quadrifilar helix antenna implemented in accordance with the teachings of the present invention 87. Two azimuth polar plots are shown in FIG. 8. Circle 85 represents elevation angle of zero degrees or the horizon. As seen in FIG. 8, the terrestrial radiation pattern of the novel antenna is better by approximately 3 dB. S Thus a significant improvement in terrestrial reception is achieved without degradation on satellite performance.

It should be noted that the embodiments described herein should not limit the scope of the invention. For example, the quadrifilar antenna in accordance with the present invention can be tuned to receive signals not only for Satellite Digital Audio Radio System (SDARS) signals, but also global positioning satellite signals, or other suitable satellite or terrestrial signals.

As previously mentioned, although the present invention is described with specific embodiments, variations of these embodiments would still provide excellent performance and should be contemplated and interpreted within the scope of the present invention. For example: parasitic metallic lines or rings do not have to be parallel with respect to each other. Parasitic metallic lines do not have to be etched on the same side of a substrate. Parts of quadrifilar elements and parts of rings can be etched on the same substrate side. Both parts of quadrifilar elements and parts of rings can be arranged on the same tubular structure. At least one metallic ring can be arranged on a different tubular structure than other metallic rings. One or more pings may form open ends resulting in open loops. One or more pings can be connected to other pings. Quadrifilar elements and rings can be realized with slots. Rings or loops can extend beyond the length of the quadrifilar antenna. The quadrifilar antenna can be any type of helix antenna. Rings or loops can be part of the antenna radome or housing. Rings or loops can be active rings, i.e., they can be connected to one or more antenna elements.

The invention claimed is:

1. An antenna structure comprised of:

a multifilar helix antenna etched on a flexible substrate;

substantially parallel and substantially concentric metallic rings positioned around the longitudinal axis of the helix antenna and along at least one of a total length or a partial length of the helix antenna, wherein the substantially concentric metallic rings are parasitically coupled and permanently fixed to the multifilar helix antenna; and wherein at least one of the substantially parallel and substantially concentric metallic rings is a closed looped metallic ring.

2. The antenna structure of claim 1 where the substantially parallel and substantially concentric metallic rings are closed looped metallic rings.

3. The antenna structure of claim 1 where the helix antenna is a standard monofilar helix antenna.

4. The antenna structure of claim 1 where the substantially parallel and substantially metallic rings are etched on a flexible substrate.

5. The antenna structure of claim 1 where at least one of the metallic rings are etched on the same substrate as the multifilar helix antenna.

6. The antenna structure of claim 1 where at least one of the metallic rings are etched on a different substrate than that of the multifilar helix antenna.

7. The antenna structure of claim 1 where the metallic rings are part of a radome that houses the multifilar helix antenna.

8. The antenna structure of claim 1 where at least one of the metallic rings is an open ended metallic loop.

9. The antenna structure of claim 1 where at least one of the metallic rings is connected to at least one other ring.

10. The antenna structure of claim 1 where at least one of the rings is electrically connected to at least one antenna helical element.

11. The antenna structure of claim 1, where the helix antenna is a quadrifilar helix antenna.

12. The antenna structure of claim 8, where the open ended metallic loop is formed from one or more open ended rings.

13. The antenna structure of claim 8, where the open ended metallic loop includes overlapping rings.

14. A method for reducing the height of a helix antenna by using substantially parallel and substantially concentric metallic parasitic rings positioned around the longitudinal axis of the helix antenna and along at least one of a total length or a partial length of the helix antenna.

15. A method for tuning a multifilar helix antenna by using substantially parallel and substantially concentric metallic parasitic rings that are permanently fixed to a plurality of helices of the multifilar helix antenna and that are positioned around the longitudinal axis of the helix antenna and along at least one of a total or a partial length of the helix antenna.

16. An antenna structure comprised of:

a mast-type multifilar helix antenna; and substantially parallel and substantially concentric closed loop metallic rings positioned around the longitudinal axis of the mast-type multifilar helix antenna and along at least one of a total length or a partial length of the antenna, wherein the substantially concentric closed loop metallic rings are parasitically coupled to the mast-type multifilar helix antenna.

17. The antenna structure of claim 16, where the mast-type multifilar antenna is a quadrifilar helix antenna.

* * * * *